US005507917A

United States Patent [19]

Didier et al.

[11] Patent Number: 5,507,917

[45] Date of Patent: Apr. 16, 1996

[54] DOCTOR FOR CREPING TISSUE

[75] Inventors: James J. Didier, Beloit, Wis.; Arnold J. Roerig, Gold Canyon, Ariz.

[73] Assignee: Beloit Technologies, Inc., Wilmington, Del.

[21] Appl. No.: 248,272

[22] Filed: May 24, 1994

[51] Int. Cl.[6] ..... D21G 3/00; D21G 3/04; B21F 1/00

[52] U.S. Cl. ..... 162/281; 15/256.5; 15/256.52; 162/111

[58] Field of Search ..... 162/111, 280, 162/281, 282; 15/256.5, 256.51, 256.52, 256.53

[56] References Cited

U.S. PATENT DOCUMENTS 4,919,756 4/1990 Sawdai ..... 162/111
5,066,364 11/1991 Goodnow et al. ..... 162/281

FOREIGN PATENT DOCUMENTS 9306300 4/1993 WIPO ..... D21G 3/04

*Primary Examiner*—David L. Lacey
*Assistant Examiner*—Jose S. Fortuna
*Attorney, Agent, or Firm*—Dirk J. Veneman; Raymond W. Campbell; David J. Archer

[57] ABSTRACT

A doctor for creping tissue from a surface of a Yankee dryer is provided. The doctor includes a frame and a support which extends from the frame. A swing arm is pivotally secured to the support about a pivotal bearing. The swing arm defines a further bearing. A pivot extends through the further bearing for rotatable movement relative to the swing arm such that the pivot is rotatably supported by the swing arm. A doctor is rigidly secured to the pivot for doctoring the tissue from the surface of the dryer. A blade is removably secured to the doctor, the blade defining an operative edge which cooperates with the surface of the Yankee dryer for creping the tissue from the surface of the dryer. A loader is operatively connected to the pivot for rotating the pivot within the further bearing for loading the operative edge against the surface of the dryer. A blade angle changer is operatively connected to the swing arm for pivoting the swing arm relative to the support, the arrangement being such that movement of the angle changer selectively changes an angle defined between the blade and the surface of the dryer. The operative edge is disposed substantially along an axis of rotation of the pivotal bearing, the arrangement is such that when the blade wears due to contact with the operative edge with the surface of the dryer, the angle is changed to optimize the creping without significantly altering the disposition of the operative edge relative to the surface of the dryer.

12 Claims, 4 Drawing Sheets

DOCTOR FOR CREPING TISSUE

BACKGROUND OF THE INVENTION

1. Field of the Invention

The present invention relates to a doctor for creping tissue from a surface of a Yankee dryer. More particularly, the present invention relates to a doctor having a blade, the angle of which may be selectively changed.

2. Information Disclosure Statement

In the manufacture of tissue, a web of tissue is formed on a forming wire and is subsequently guided around a Yankee dryer. A Yankee dryer is a cylindrical dryer having a diameter of approximately 20–30 foot and is internally heated by steam. The Yankee dryer defines a smooth outer peripheral surface on which the tissue is guided and dried.

A plurality of doctor blades are disposed in abutting relationship with the heated surface of the Yankee dryer at a downstream location thereof for doctoring the tissue from the heated surface of the dryer when the tissue has been sufficiently dried by the Yankee dryer.

The aforementioned plurality of doctors includes a skinning doctor disposed upstream and a cleaning doctor disposed downstream, with a creping doctor disposed between the skinning and cleaning doctors.

During the production of tissue, the creping doctor is disposed in operative cooperation with the surface of the dryer, while the skinning doctor is disposed in a position away from the dryer surface.

With particular reference to the creping doctor, the doctor blade is disposed at an angle relative to the heated surface of the dryer for creping the tissue off of the heated surface. Such removal of the tissue from the heated surface generates minute ripples in the removed tissue for providing the required bulk, softness, and other desirable qualities of the resultant tissue.

More specifically, the aforementioned angle of the blade relative to the dryer surface has a profound effect on the quality of the resultant tissue.

However, during use of the creping doctor due to the frictional engagement of the operative edge of the blade against the surface of the dryer, there exists a tendency for the blade to wear, thereby altering the aforementioned angle.

Consequently, in order to maintain an optimum quality of the resultant tissue, it is necessary to adjust the position of the doctor so that the aforementioned angle is maintained.

Additionally, it is important that the angle of the blade relative to the dryer surface be adjustable in order to accommodate various types of tissue to obtain the aforementioned optimum qualities thereof.

The present invention provides a unique means for adjusting the aforementioned angle. Basically, the present invention permits the doctor and the blade secured thereto to be selectively pivoted about an axis which extends along the operative edge of the blade.

Furthermore, the present invention includes loading means which permit the blade to be moved away from the heated surface of the dryer and back again to the operative disposition thereof so that the angle between the blade and the dryer surface is restored.

In the prior art arrangements, because the doctor is movable about a pivotal axis which does not coincide with the operative edge, difficulties have been experienced in maintaining the required angle of the blade relative to the dryer surface.

Therefore, it is a primary objective of the present invention to provide a doctor for creping tissue that overcomes the aforementioned disadvantages of the prior art arrangements and which provides a significant contribution to the art of creping tissue from a surface of a Yankee dryer.

Other objects and advantages of the present invention will be readily apparent to those skilled in the art by a consideration of the detailed description contained hereinafter, taken in conjunction with the annexed drawings.

SUMMARY OF THE INVENTION

The present invention relates to a doctor for creping tissue from a surface of a Yankee dryer. The doctor includes a frame and a supporting means which extends from the frame. A swing arm means is pivotally secured to the supporting means about a pivotal bearing. The swing arm means defines a further bearing. Pivot means extend through the further bearing for rotatable movement relative to the swing arm means such that the pivot means is rotatably supported by the swing arm means. Doctor means are rigidly secured to the pivot means for doctoring the tissue from the surface of the dryer. Blade means are removably secured to the doctor means, with the blade means defining an operative edge which cooperates with the surface of the Yankee dryer for creping the tissue from the surface of the dryer. Loading means are operatively connected to the pivot means for rotating the pivot means within the further bearing for loading the operative edge against the surface of the dryer. Blade angle changing means are operatively connected to the swing arm means for pivoting the swing arm means relative to the support means. The arrangement is such that movement of the changing means selectively changes an angle defined between the blade means and the surface of the dryer.

The operative edge is disposed substantially along an axis of rotation of the pivotal bearing. The arrangement is such that when the blade means wears due to contact of the operative edge thereof with the surface of the dryer, the angle is changed to optimize the creping without significantly altering the disposition of the operative edge relative to the surface of the dryer.

Many modifications and variations of the present invention will be readily apparent to those skilled in the art by a consideration of the detailed description contained hereinafter, taken in conjunction with the annexed drawings. However, such variations and modifications fall within the spirit and scope of the present invention as defined by the claims.

BRIEF DESCRIPTION OF THE DRAWINGS

Similar reference characters refer to similar parts throughout the various views of the drawings.

DETAILED DESCRIPTION OF THE DRAWINGS

Figure 1:
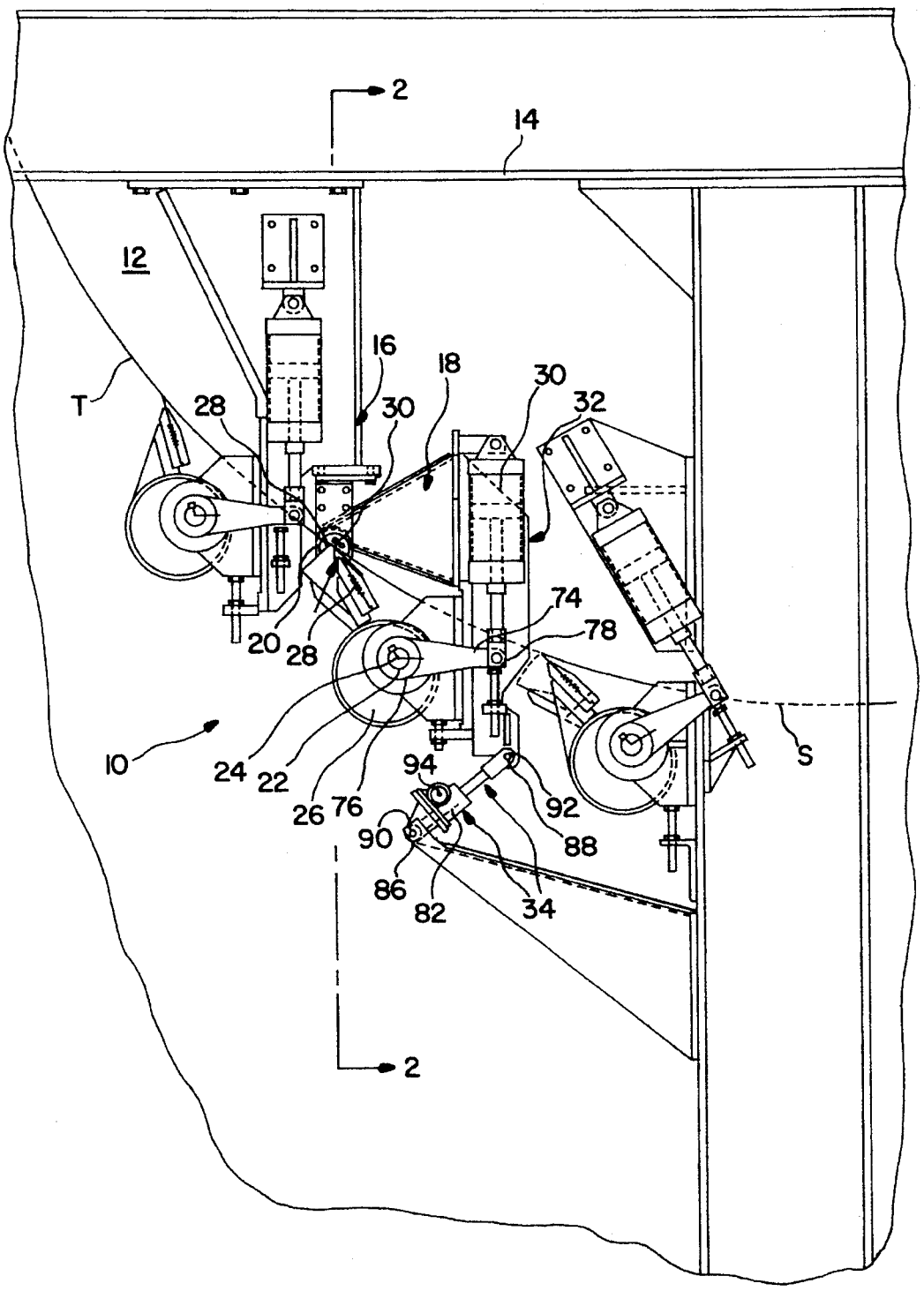
FIG. 1 is a side-elevational view of a doctor for creping tissue from a surface of a Yankee dryer according to the present invention.

FIG. 1 is a side-elevational view of a doctor, generally designated 10, for creping tissue T from a surface S of a Yankee dryer 12 according to the present invention.

The doctor 10 includes a frame 14 and a supporting means, generally designated 16, which extends from the frame 14. A swing arm means, generally designated 18, is pivotally secured to the supporting means 16 about a pivotal bearing 20. The swing arm means 18 defines a further bearing 22. Pivot means, generally designated 24, extend through the further bearing 22 for rotatable movement relative to the swing arm means 18 such that the pivot means 24 is rotatably supported by the swing arm means 18.

Doctor means 26 are rigidly secured to the pivot means 24 for doctoring the tissue T from the surface S of the dryer 12.

Blade means 28 are removably secured to the doctor means 26. The blade means 28 defines an operative edge 30 which cooperates with the surface S of the Yankee dryer 12 for creping the tissue T from the surface of the dryer 12.

Loading means, generally designated 32, are operatively connected to the pivot means 24 for rotating the pivot means 24 within the further bearing 22 for loading the operative edge 30 against the surface ,$ of the dryer 12.

Blade angle changing means, generally designated 34, are operatively connected to the swing arm means 18 for pivoting the swing arm means 18 relative to the support means 16. The arrangement is such that movement of the changing means 34 selectively changes an angle α defined between the blade means 28 and the surface S of the dryer 12.

Figure 2:
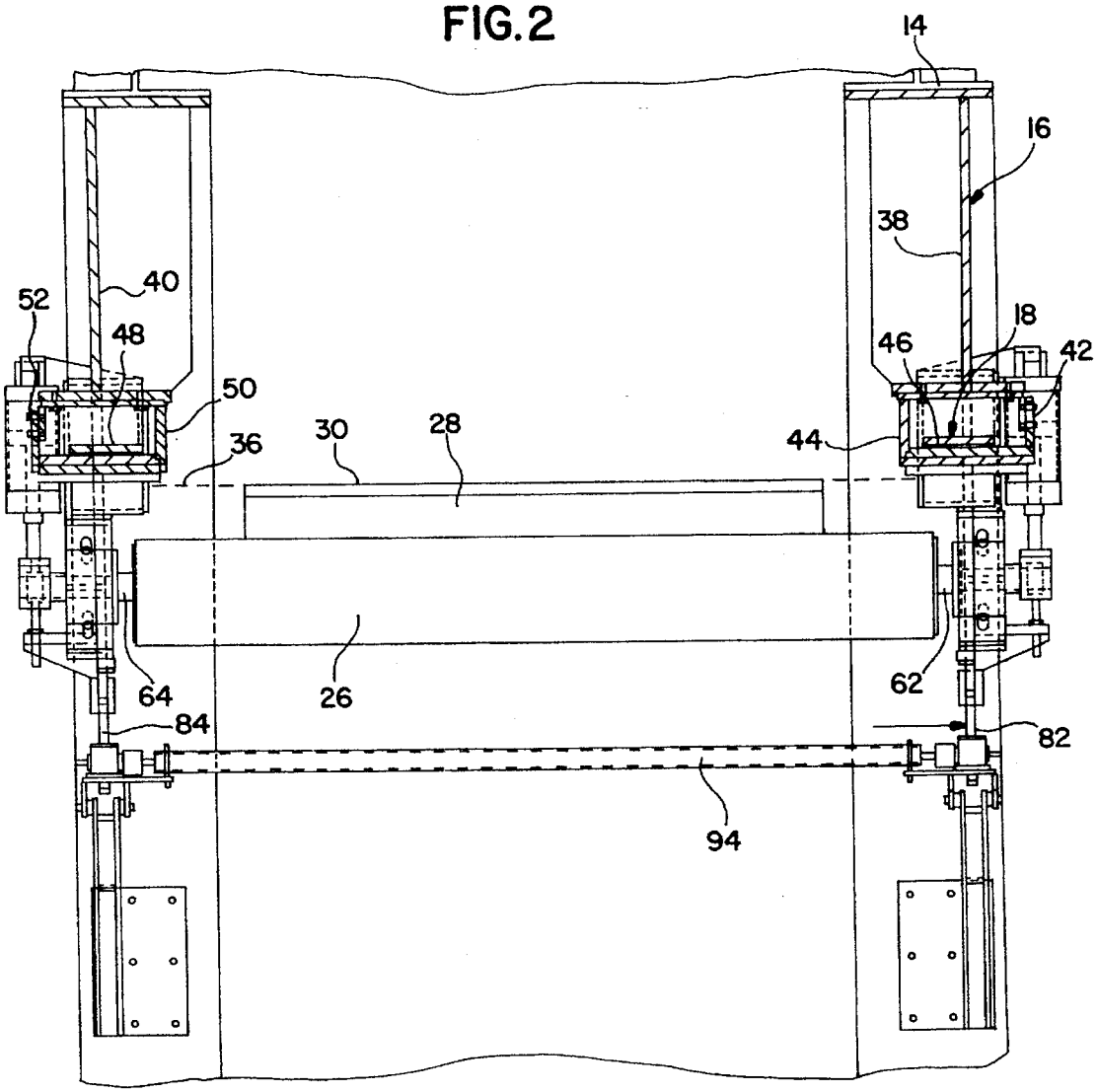
FIG. 2 is a sectional view taken on the line 2—2 of FIG. 1.

FIG. 2 is a sectional view taken on the line 2—2 of FIG. 1. As shown in FIG. 2, the operative edge 30 is disposed substantially along an axis of rotation 36 of the pivotal bearing 20. The arrangement is such that when the blade means 28 wears due to contact of the operative edge 30 with the surface S of the dryer 12, the angle α is changed to optimize creping without significantly altering the disposition of the operative edge 30 relative to the surface S of the dryer 12.

As shown in FIG. 1, the dryer 12 is rotatably secured relative to the frame 14.

FIG. 2 shows the supporting means, generally designated 16, as including a first and second support 38 and 40, respectively, spaced relative to each other such that the doctor means 26 is disposed therebetween.

More specifically, as shown in FIG. 2, each of the supports 38 and 40 includes a bifurcated portion 42 and 44, respectively.

As shown in FIG. 2, the swing arm means, generally designated 18, includes a first and second swing arm 46 and 48, respectively, spaced relative to each other such that the doctor means 26 is disposed therebetween.

Additionally, the first and second swing arms 46 and 48, respectively, cooperate with and are disposed between the first and second bifurcated portions 42 and 44, respectively, and 50 and 52.

Figure 3:
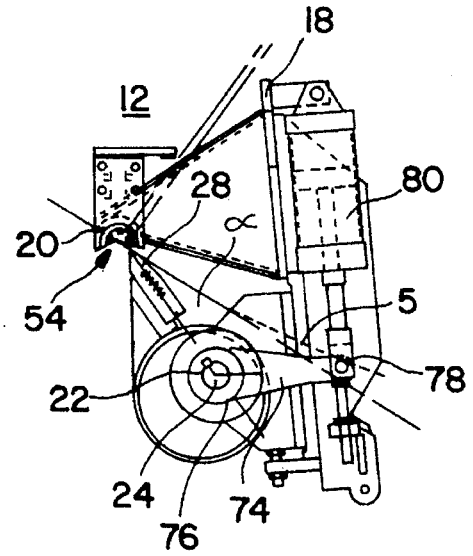
FIG. 3 is a fragmentary view of FIG. 1 and shows the creping blade defining an angle of approximately 20 degrees.
Figure 4:
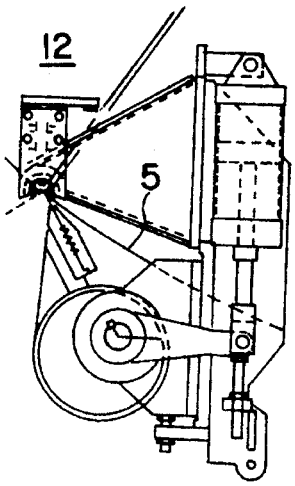
FIG. 4 is a similar view to that shown in FIG. 3, but shows a blade angle of approximately 25 degrees.
Figure 5:
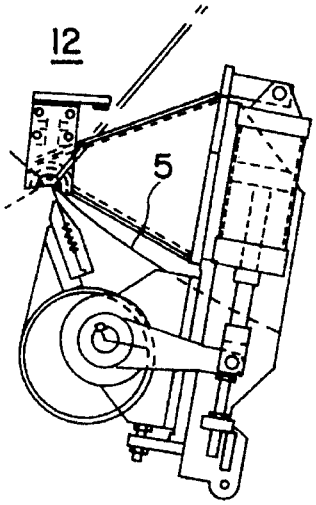
FIG. 5 is a similar view to that shown in FIG. 3, but shows a blade angle of approximately 30 degrees.

FIGS. 3, 4 and 5 are fragmentary views of the creping doctor 26 disposed in operative cooperation with the surface S of the dryer 12 and defining a blade angle α of 20, 25 and 30 degrees, respectively, with the heated surface S.

As shown in FIG. 3, the pivotal bearing 20 defines an axial opening 54 for permitting the movement therethrough of the blade means 28.

Figure 6:
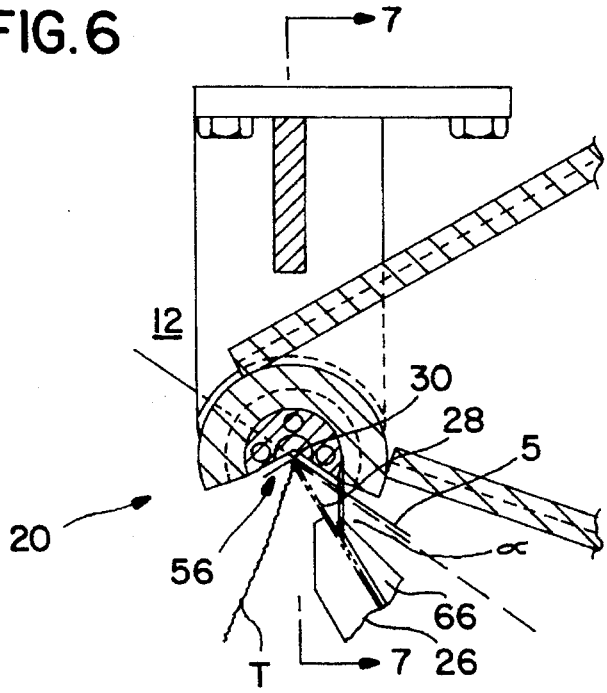
FIG. 6 is an enlarged side-elevational view of the pivotal bearing according to the present invention.

FIG. 6 is an enlarged view of the pivotal bearing 20. More specifically, the pivotal bearings 20 defines a sector-shaped void 56 for permitting ready access to the blade means 28.

Figure 7:
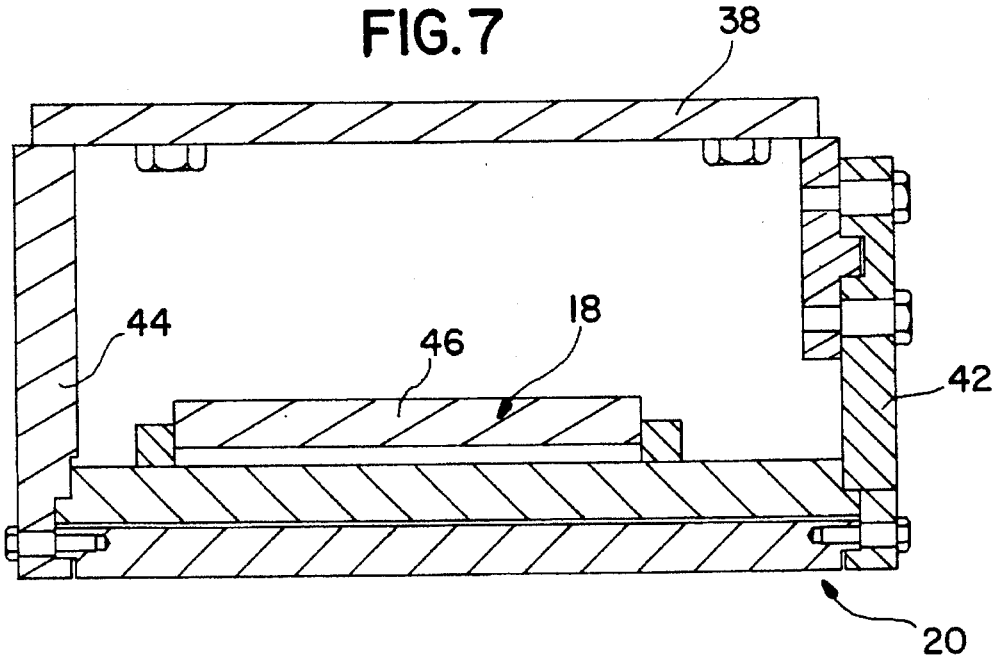
FIG. 7 is a sectional view taken on the line 7—7 of FIG. 6.

FIG. 7 is a sectional taken on the line 7—7 of FIG. 6 and shows a portion of the swing arm 46 slidably and rotatably secured relative to the support 38. Also, the areas that slide during rotation, such as 20 and 22 are fitted with bearing materials such as Teflon or composite bearing materials.

Figure 8:
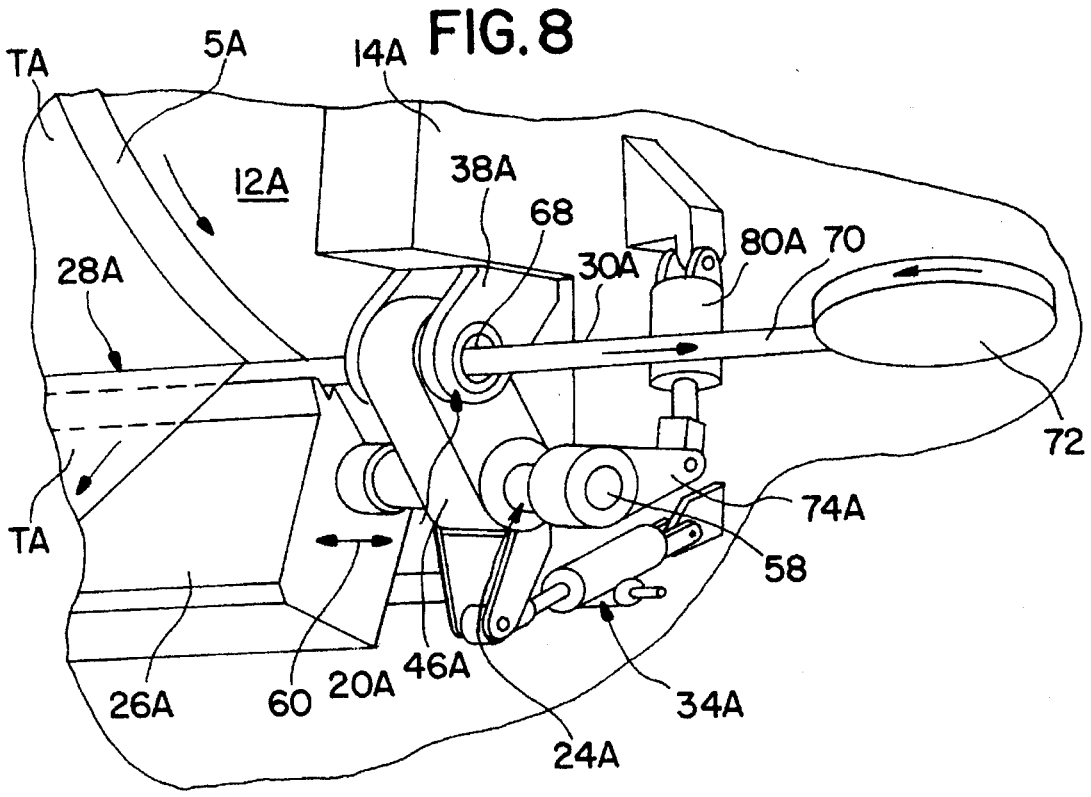
FIG. 8 is a perspective view of an alternative embodiment of the present invention.

FIG. 8 is a perspective view of an alternative embodiment of the present invention. As shown in FIG. 8, the pivot means 24A also includes means 58, for oscillating the pivot means 24A and the doctor means 26A attached thereto axially, as indicated by the arrow 60, relative to the surface SA of the dryer 12A.

With reference to FIGS. 1–7, the pivot means, generally designated 24, includes a first and second pivot 62 and 64, respectively shown in FIG. 2, which cooperate respectively with the first and second swing arms 46 and 48 such that the doctor means 26 is disposed between the first and the second pivots 62 and 64. The arrangement is such that the pivots 62 and 64 and doctor means 26 are rotatably supported by the swing arms 46 and 48.

The blade means 28, as shown in FIG. 6, include clamping means 66 secured to the doctor means 26 for releasably securing the blade means 28 relative to the doctor means 26.

Removal of the blade means 28 is permitted when the clamping means 66 is released, thereby permitting removal of the blade means 28 axially through the pivotal bearing 20.

FIG. 8 shows the pivotal bearing 20A defining an axial opening 68 for the movement therethrough of a ribbon-type blade 70.

As shown in FIG. 8, the blade means 28A also includes a reel 72 for rotatably receiving the operative edge 30A so that continuous replenishment of the blade means 28A is permitted.

As shown in FIGS. 1–5, the loading means, generally designated 32, includes an arm 74 rigidly secured to the pivot means 24 and extending radially therefrom. The arm 74 has a proximal and a distal end 76 and 78, respectively.

Actuating means 80, which may be a pneumatic or hydraulic cylinder or the like, is pivotally secured to the distal end 78 of the arm 74. The actuating means 80 extends between the distal end 78 and the swing arm means 18. The arrangement is such that when the actuating means 80 is actuated, the arm 74 is pivoted so that the pivot means 24 pivots within the further bearing 22 for urging the blade means 28 towards the surface S of the dryer 12 or away to a non-operative disposition thereof.

As shown in FIGS. 1 and 2, the angle changing means, generally designated 34, further includes a first and second jack means 82 and 84 shown in FIG. 2. The jack means 82 and 84 are spaced relative to each other such that the doctor means 26 is disposed therebetween. Each of the jack means 82 and 84 have a first and second end 86 and 88, respectively, as shown in FIG. 1. The first end 86 of the jack means 82 is pivotally secured to the frame 14 at 90, while the second end 88 of the jack means 82 is pivotally secured to the swing arm means 18 at 92.

Additionally, as shown in FIGS. 1 and 2, the angle changing means 34 further includes worm gear means 94 extending between the first and second jack means 82 and 84. The arrangement is such that rotation of the worm means 94 simultaneously adjusts both the first and second jack means 82 and 84, respectively, as particularly shown in FIG. 2 so that the angle α along the entire length of the blade means 28 relative to the surface S of the dryer 12 is simultaneously changed.

In operation of the doctor, according to the present invention, the actuating means 80 moves the arms 74 in a clockwise direction, as viewed in FIG. 1, so that the operative edge 30 abutts against the surface S of the dryer 12, so that tissue T is creped from the surface S.

As the operative edge 30 wears down, the worm means 94 is rotated so that the swing arm means 18 is moved in a clockwise direction to increase the angle α between the blade means 28 and the surface S.

When a blade means 28 is to be replaced, the actuating mean 80 is actuated to move the arm 74 in a counter-clockwise direction, thereby unloading the blade means.

Subsequently, the blade clamping means 26 is released so that a new blade means 28 can be readily inserted. When the clamping means 66 has been closed to clamp the blade means 28, the actuating means 80 once again moves the arms 74 in clockwise direction, to move the replacement blade means 28 against the surface S with the blade means 28 being located within the sector-shaped void 56.

The present invention provides a doctor for creping tissue which permits selective adjustment of the angle of the blade relative to the dryer surface without substantially altering the disposition of the operative edge relative to the dryer surface. The aforementioned advantage is obtained primarily by pivoting the doctor and blade supported thereon about a pivotal axis which is coincident with the operative edge of the blade.

What is claimed is:

1. A doctor for creping tissue from a surface of a Yankee dryer, said doctor comprising:

a frame;

a supporting means extending from said frame;

a swing arm means pivotally secured to said supporting means about a pivotal bearing, said swing arm means defining a further bearing;

pivot means extending through said further bearing for rotatable movement relative to said swing arm means such that said pivot means is rotatably supported by said swing arm means;

doctor means rigidly secured to said pivot means for doctoring the tissue from the surface of the dryer;

blade means removably secured to said doctor means, said blade means defining an operative edge which cooperates with the surface of the Yankee dryer for creping the tissue from the surface of the dryer;

loading means operatively connected to said pivot means for rotating said pivot means within said further bearing for loading said operative edge against the surface of the dryer;

blade angle changing means operatively connected to said swing arm means for pivoting said swing arm means relative to said support means, the arrangement being such that movement of said blade angle changing means selectively changes an angle defined between said blade means and the surface of the dryer;

said operative edge being disposed substantially along an axis of rotation of said pivotal bearing, the arrangement being such that when said blade means wears due to contact of said operative edge with the surface of the dryer, said angle is changed to optimize said creping without significantly altering the disposition of said operative edge relative to the surface of the dryer; and said pivotal bearing being constructed so as to define a void which permits the ready access to said blade means.

2. A doctor as set forth in claim 1, wherein said pivot means further includes:

means for oscillating said pivot means and said doctor means attached thereto axially relative to the surface of the dryer.

3. A doctor as set forth in claim 1, wherein said loading means includes:

an arm rigidly secured to said pivot means and extending radially therefrom, said arm having a proximal and a distal end thereof;

actuating means pivotally secured to said distal end of said arm, said actuating means extending between said distal end and said swing arm means, the arrangement being such that when said actuating means is actuated, said arm is pivoted so that said pivot means pivots within said further bearing for urging said blade means towards the surface of the dryer.

4. A doctor as set forth in claim 1, wherein said blade angle changing means further includes:

a first and second jack means spaced relative to each other such that said doctor means is disposed therebetween;

each of said jack means having a first and a second end, said first end being pivotally secured to said frame, said second end being pivotally secured to said swing arm means.

5. A doctor as set forth in claim 1, wherein said blade means further includes:

clamping means secured to said doctor means for releasably securing said blade means relative to said doctor means.

6. A doctor as set forth in claim 5, wherein removal of said blade means is permitted when said clamping means is released for permitting removal of said blade means axially through said pivotal bearing.

7. A doctor as set forth in claim 6, wherein said blade means further includes:

a reel for rotatably receiving said operative edge so that continuous replenishment of said blade means is permitted.

8. A doctor as set forth in claim 7, wherein said supporting means includes a first and a second support spaced relative to each other such that said doctor means is disposed therebetween.

9. A doctor as set forth in claim 8, wherein each of said supports includes a bifurcated portion.

10. A doctor as set forth in claim 9, wherein said swing arm means includes:

a first and second swing arm spaced relative to each other such that said doctor means is disposed therebetween;

said swing arms respectively cooperating with and being disposed between said first and second bifurcated portion.

11. A doctor as set forth in claim 10, wherein said pivot means includes:

a first and second pivot cooperating respectively with said first and second swing arms such that said doctor means is disposed between said first and second pivots, the arrangement being such that said pivots and doctor means are rotatably supported by said swing arms.

12. A doctor for creping tissue from a surface of a Yankee dryer, said doctor comprising:

a frame;

a supporting means extending from said frame;

a swing arm means pivotally secured to said supporting means about a pivotal bearing, said swing arm means defining a further bearing;

pivot means extending through said further bearing for rotatable movement relative to said swing arm means such that said pivot means is rotatably supported by said swing arm means;

doctor means rigidly secured to said pivot means for doctoring the tissue from the surface of the dryer;

blade means removably secured to said doctor means, said blade means defining an operative edge which cooperates with the surface of the Yankee dryer for creping the tissue from the surface of the dryer;

loading means operatively connected to said pivot means for rotating said pivot means within said further bearing for loading said operative edge against the surface of the dryer;

blade angle changing means operatively connected to said swing arm means for pivoting said swing arm means relative to said support means, the arrangement being such that movement of said blade angle changing means selectively changes an angle defined between said blade means and the surface of the dryer;

said operative edge being disposed substantially along an axis of rotation of said pivotal bearing, the arrangement being such that when said blade means wears due to contact of said operative edge with the surface of the dryer, said angle is changed to optimize said creping without significantly altering the disposition of said operative edge relative to the surface of the dryer; and said pivotal bearing being constructed so as to define a void which permits the ready access to said means; and said blade angle changing means further including:

a first and second jack means spaced relative to each other such that said doctor means is disposed therebetween;

each of said jack means having a first and a second end, said first end being pivotally secured to said frame, said second end being pivotally secured to said swing arm means; and worm gear means extending between said first and second jack means, the arrangement being such that rotation of said worm means simultaneously adjusts both said first and said second jack means so that said angle along the entire length of said blade means relative to the surface of the dryer is simultaneously changed.

* * * * *

UNITED STATES PATENT AND TRADEMARK OFFICE

CERTIFICATE OF CORRECTION

PATENT NO. : 5,507,917

DATED : 04/16/96

INVENTOR(S) : Didier et al

It is certified that error appears in the above-indentified patent and that said Letters Patent is hereby corrected as shown below:

Column 3, line 33: ",$" should read --S--.

Signed and Sealed this

Eighteenth Day of March, 1997

*Attest:*

*Attesting Officer*

BRUCE LEHMAN

*Commissioner of Patents and Trademarks*